United States Patent [19]

Milberger et al.

[11] 4,047,046

[45] Sept. 6, 1977

[54] CIRCUIT FOR SETTING MAGNETIC REMANENCE IN A MAGNETIZABLE CORE

[75] Inventors: Walter E. Milberger, Severna Park; Gerald I. Klein, Baltimore, both of Md.

[73] Assignee: Westinghouse Electric Corporation, Pittsburgh, Pa.

[21] Appl. No.: 646,790

[22] Filed: Jan. 6, 1976

[51] Int. Cl.[2] ..... H01F 13/00

[52] U.S. Cl. ..... 307/101; 307/314; 307/88 R; 307/88 MP

[58] Field of Search ..... 307/101, 314, 88 R, 307/88 MP; 323/56; 317/157.5 PM

[56] References Cited

U.S. PATENT DOCUMENTS

| | | | |
|---|---|---|---|
| 3,159,752 | 12/1964 | Domburg et al. | 307/101 |
| 3,200,382 | 8/1965 | Busch | 307/88 MP |
| 3,510,675 | 5/1976 | Johnson et al. | 307/101 |

FOREIGN PATENT DOCUMENTS

| | | | |
|---|---|---|---|
| 1,125,903 | 9/1968 | United Kingdom | 307/101 |

OTHER PUBLICATIONS

Bright et al., "Transistors as On-Off Switches in Saturable Core Circuits," *Electrical Manufacturing*, vol. 54, 12/54, pp. 79–82.

*Primary Examiner*—Robert K. Schaefer
*Assistant Examiner*—Eugene S. Indyk
*Attorney, Agent, or Firm*—C. F. Renz

[57] ABSTRACT

A circuit for selectively variably setting the magnetic remanence in a magnetizable core employs flux circuit feedback, including feedback initiating a self-blocking oscillator type of operation, to achieve designs of two or three (as the designer may desire) elementary sequences (referred to in the art as cycles) to erase previous remanent flux density and to set a new remanent flux density. The circuit apparatus is amenable to constructions using single monolithic integrated circuit chip techniques.

10 Claims, 10 Drawing Figures

CIRCUIT FOR SETTING MAGNETIC REMANENCE IN A MAGNETIZABLE CORE

BACKGROUND OF THE INVENTION

1. Field of the Invention

The present invention relates to circuit apparatus for selectively variably setting remanent magnetic flux density in magnetic cores which are part of magnetic circuits responsive to such setting. This type of circuit apparatus is sometimes referred to as a core drive circuit.

2. Description of the Prior Art

A specific application of circuit apparatus of the type referred to is as a component of ferrite core phaseshifter assemblies employed in phased antenna systems. The advent of phased arrays containing many individual radiators has caused a high degree of interest in reducing the cost of core driver circuits. The design technique for such circuits have included circuits which employ so-called two-cycle operation, and circuits which employ so-called three-cycle operation. In the two-cycle operation the magnetic remanence is reset to its referenced insertion state along the flux density (B) versus magnetizing force (H) hysteresis loop curve (the first cycle) and then set to the desired new setting (the second cycle). In the three-cycle operation the previously set flux density state is passed along the hysteresis loop to a full-set condition (first cycle), then reset to the insertion state (second cycle) and finally set to the new desired setting (third cycle). The three-cycle operation provides more effective erasure of a previous set state than the two cycle operation.

In the prior art, the broad approach of employing a flux circuit regenerative feedback via a feedback winding to achieve circuit switching and self-blocking oscillator relationships is known. An example is disclosed in U.S. Pat. No. 3,159,752 to J. Domberg et al., which discloses this approach in connection with a one-shot pulse generator.

Also known in the prior art is the technique of sensing the magnitude of flux density in a core driven by a drive circuit by integrating the voltage from a winding other than the drive winding. An example of such circuit is disclosed in U.S. Pat. No. 3,510,675 to T. A. Johnson et al.

Prior to the present invention there has been no known use of regenerative feedback in the sequencing of a drive circuit through the previously referred to cycles, nor the combination of regenerative feedback techniques with the technique of sensing flux density by the integration of a voltage from a second winding.

SUMMARY OF THE INVENTION

Circuit apparatus is provided to selectively variably set the magnetic remanence in a magnetizable core. The magnetizable core has a reset winding and a set winding respectively driven by a reset driver switch and a set driver switch. The windings are so arranged that they provide opposite polarity of magnetic coupling with the core when driven by the respective driver switches. The reset winding with the current flow therethrough provided by the reset drive changes the flux density in the direction of negative flux of the B-H hysteresis curve. The set winding with the current flow therethrough provided by the set drive changes the flux density in the positive direction. The set winding and the reset winding are used as positive feedback paths to regeneratively maintain the reset driver and the driver, respectively turned on. Saturation of the core in the negative direction terminates the reset elementary sequence, or cycle, in a fashion broadly providing a blocking oscillator relationship, and also initiates the next cycle. In the case of a three-cycle embodiment having a preliminary cycle, which provides full set to positive core saturation before reset, positive magnetic saturation terminates the preliminary cycle in a blocking oscillator relationship, and also initiates the next cycle. The flux density which is to be set in the core is controlled by comparing a voltage which is a derivative of core flux to a calibrated reference voltage applied as a setting command. Coincidence of the two voltages interrupt the positive feedback pass from the reset winding to the set driver. This action causes the core to latch at a remanent flux density status corresponding to the flux density status commanded by application of the reference voltage.

DESCRIPTION OF THE PREFERRED EMBODIMENT

Figure 1:
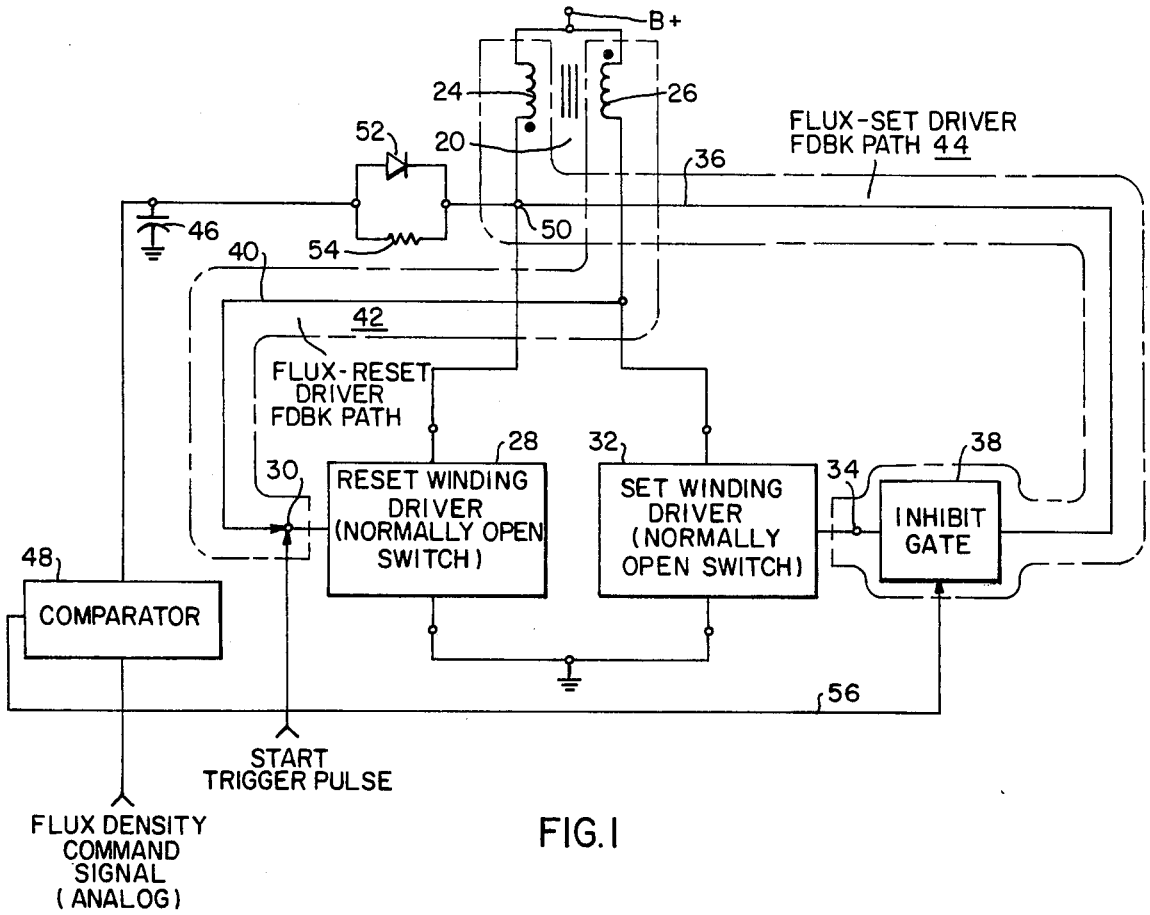
FIG. 1 is a block diagram of circuit apparatus in accordance with the present invention.
Figure 2:
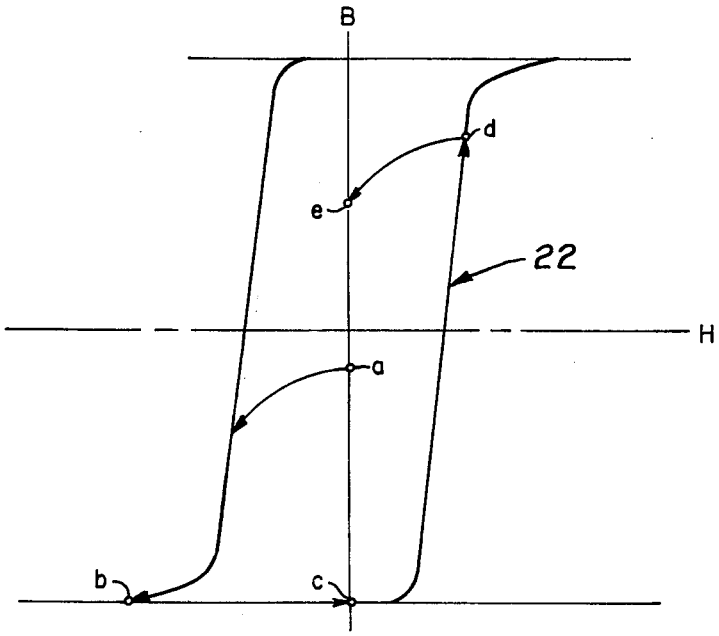
FIG. 2 is a curve representing the magnetic flux density (B) versus magnetic field strength (H) relationship of the magnetizable core of the apparatus of FIG. 1, and further includes points thereon identified in connection with a description of the operation of the circuit apparatus of FIG. 1.

Referring now to the drawing and in particular to FIG. 1 a magnetizable core 20 is made of ferrite, or other suitable material, which provides a generally rectangular magnetic flux density (B) versus magnetic field strength (H), curve 22, FIG. 2. A pair of windings consisting of a reset winding 24 and a set winding 26, are coupled to core 20. Windings 24 and 26 each have one of their ends coupled to a source of positive voltge B+. A reset winding driver 28, comprising a normally open electronic switch, is actuable in response to a positive potential applied to a driver control terminal 30 to provide a conduction path from ground to the other end of reset winding 24. A like set winding driver 32 having a control terminal 34, is actuable to provide a conduction path from ground to the other end of set winding 26.

The dots which are shown at one end of each of windings 24 and 26 indicate that the end of the winding so marked has a positive voltage induced therein with respect to the other end of the winding in the case of a positive induction change in the core. An inherent property of the provision of a pair of coupled windings having dots at opposite ends is that the presence of a changing voltage of given polarity across one winding will cause the induction of a voltage of opposite polarity across the other. The potential at the driven end of reset winding 24 is applied to the control terminal 34 of set winding driver 32 via a feedback conductor 36. Feedback conductor 36 has in series therewith an inhibit gate 38, the purpose of which will become understood as the description proceeds. The potential at the driven end of set winding 26 is applied to the control terminal 30 of reset winding driver 28 via a feedback conductor 40. It will be appreciated that the set winding 26, feedback conductor 40, and driver control terminal 30 comprise a positive, or regenerative, feedback path 42 between reset winding 24 and the driver switch 28, and that this feedback path is completed through the magnetic circuit of core 20. Similarly, it will be appreciated that reset winding 24, feedback path conductor 36 and driver control terminal 34 comprise a positive, or regenerative feedback path 44, between set winding 24 and driver 32 through the magnetic circuit of core 20. The magnitude of flux density in core 20 which is set by winding 26 and driver 32 is controlled by action of an integrator capacitor 46, a comparator 48, and inhibit gate 38. A junction point 50 is provided where driver 28 is connected to reset winding. One side of capacitor 46 is connected to ground. The other side is connected to junction point 50 through a parallel network of a dumping diode 52 and an integrator circuit resistor 54. Dumping diode 52 is poled with its anode connected to capacitor 46 and its cathode to junction point 50. Comparator 48, which is of any suitable construction, compares two inputs consisting of the voltage charge across integrator capacitor 46, and an externally applied flux density command signal. The command signal is an analong voltage reference. The magnitude of reference voltage of command signal for a given flux density setting is determined by a prior calibration. Such prior calibration takes into account the relationship between the status of magnetic flux density under application of a positive magnetic field (e.g., point *d* of curve 22, FIG. 2), and the remanent magnetic flux density when the magnetic field is removed (e.g., point *e* of curve 22, FIG. 2). Inhibit gate 38 is normally in a condition which passes any feedback signal transmitted through conductor 36 to the control terminal 34 of driver 32. When the charge across capacitor 46 equals the reference voltage of the flux density command signal, comparator 48 provides an output, which is applied to inhibit gate 38 via a conductor 56. This output causes inhibit gate 38 to be in a condition which interrupts the transmission of the feedback therethrough.

Figure 3:
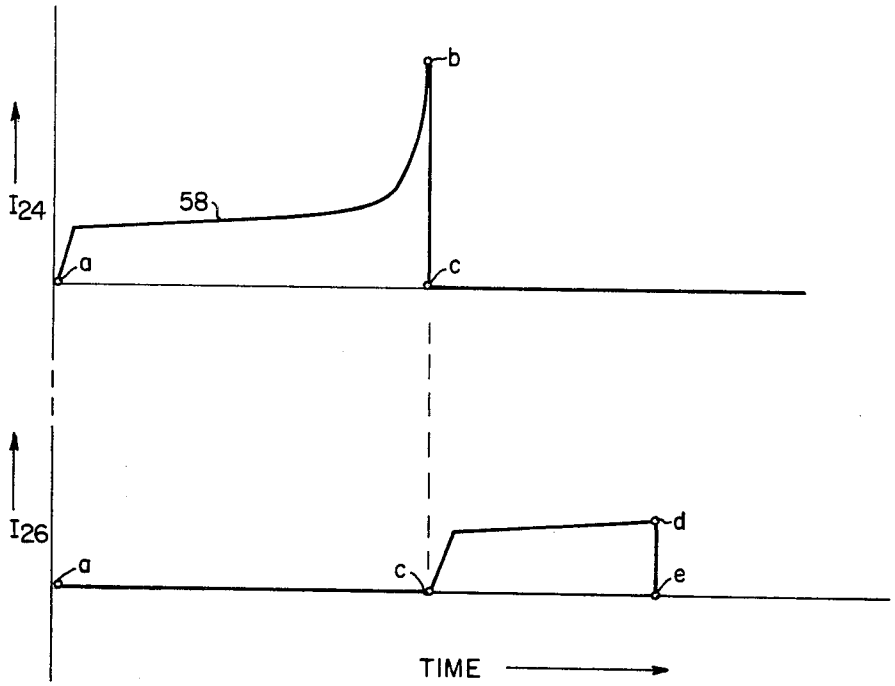
FIG. 3 is a pair of waveforms representing currents in the reset and set winding of the apparatus of FIG. 1 during the operation thereof.

Reference is now made to FIGS. 1, 2 and 3 for an explanation of the operation of the circuit apparatus just described. In the quiescent state prior to operation of the circuit apparatus, it will be assumed that the core is magnetized at a point *a,* along curve 22. In this quiescent state the current through reset coil 24 is zero, point *a* of waveform 58, FIG. 3, and the current through reset winding 26 is zero, point *a* of waveform 60, FIG. 3. As a result of the previous operating cycle, inhibit gate 38 is in its condition which interrupts feedback to control terminal 30. Prior to any triggering of the reset winding driver the new flux density command is applied to comparator 48. The setting of the magnetic density of core 20 to the newly commanded status is initiated by application of any suitable positive trigger pulse to control terminal 30 of reset driver 28. This actuates driver 28 to its conductive condition, which in turn is sustained by the feedback action of positive feedback path 42. Current flows through reset winding 24 as indicated by waveform 58, FIG. 3. The voltage charge on integrator capacitor 46 is dumped as the result of driver junction point 50 being drawn down to ground potential due to the conductive condition of driver 28. With the dumping of the charge on capacitor 46 comparator 48 ceases to apply the output to inhibit gate 38, so that feedback path 44 is no longer interrupted.

Flow of current through reset winding 24 continues until core 20 reaches full negative saturation, point *b* of curve 22, FIG. 2. Thereupon, the positive feedback from core 26 stops and driver 28 is no longer sustained in the conductive condition. Driver 28 reverts to an open switch condition. Turn off of the driver results in flux falling back to its full negative remanent position, point *c* of curve 22. It will be appreciated that this self-extinguishing of the conductive condition of driver 28 is broadly a self-blocking oscillator operational relationship produced by feedback path 42.

The collapsing field of reset winding 24 following core saturation causes the driven end of winding 24 to swing positively. That is to say, this positive swing is generated by the L(*di/dt*) of the collapsing field. This is fed back via feedback path 44, and through inhibit gate 38 (which is now in its normal conditon) to control terminal 34 of the set winding driver 32. This actuates set winding driver 32 to its conducting condition, and the resulting positive feedback via feedback path 44 sustains the conduction of driver 32. The current conduction through set winding 26, starting at point *c* of waveform 60, FIG. 3, moves the flux status in core 20 in the direction of positive saturation, curve 22, FIG. 2. The dump diode 52 is now non-conducting as the result of the positive potential at junction point 50. Capacitor 46 and resistor 54 now integrate the voltage which is flux coupled to the driven end reset winding 24 due to the conduction of set winding 26. It will be appreciated that the voltage which is being integrated across capacitor 46 is the derivative of the current through set winding 26. Accordingly, the voltage to which the integrator capacitor 46 charges is a direct measure of the change of flux density in core 20 following point *c* of curve 22, FIG. 2. This technique of sensing flux density in a core is in and of itself old in the art, and is sometimes referred to as the "flux feedback integration method" of sensing flux density. When the voltage charge on capacitor 46 reaches the magnitude of the reference voltage of the flux density command signal, the output of comparator 48 actuates inhibit gate 38 to its condition of interrupting feedback path 44. The point at which the voltage on capacitor 46 reaches the reference voltage is represented by point *d* of curve 60, FIG. 3. The flux feedback integration may be diagrammatically envisioned as the area under the waveform 60, FIG. 3, between point *c* and point *d.* The flux density in core 20 reaches a corresponding point *d* on curve 22, FIG. 2. The interruption of feedback path 42 causes the current flow through winding 26 to terminate, point *e* of curve 60, FIG. 2. The flux density in core 20 then reverts to a corresponding remanent position, point *e* of curve 22,

FIG. 2. Point *e* of curve 22 is the remanent flux magnitude corresponding to the flux density command signal (as predetermined by calibration of the reference voltage values of the command signal). The circuit apparatus will remain quiescence until the next application of a flux density command signal and starting tripper pulse.

Figure 4:
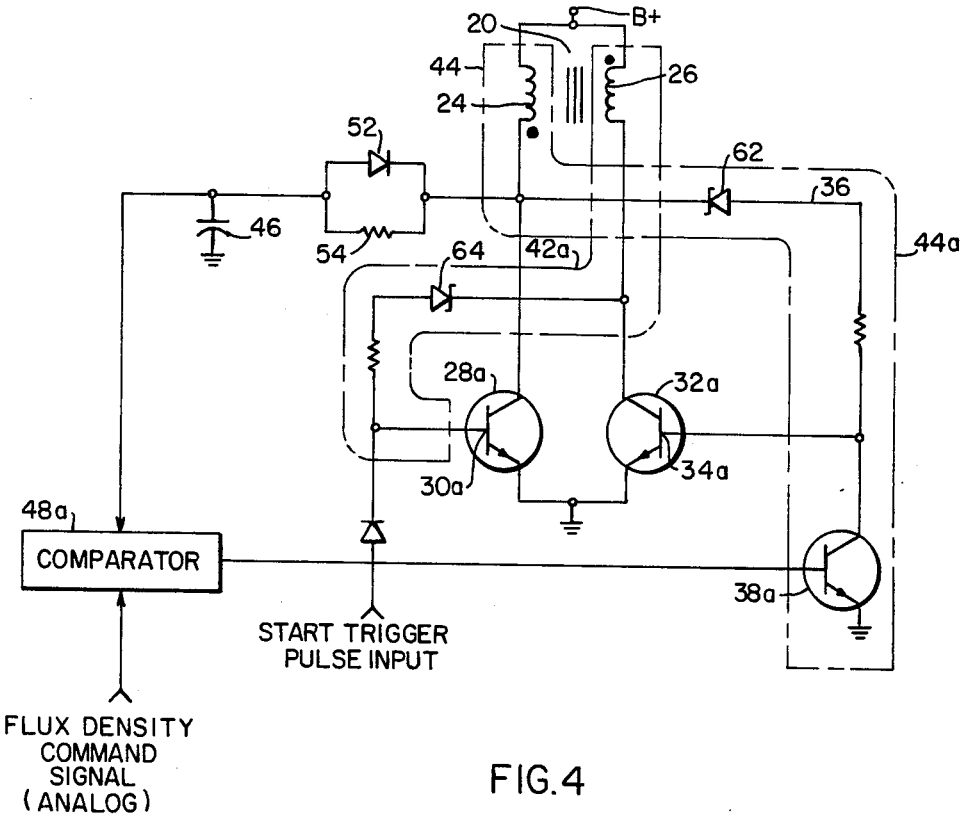
FIG. 4 is an electrical schematic of a transistorized embodiment of the circuit apparatus of FIG. 1.

FIG. 4 is a simplified transistorized implementation of the circuit apparatus of FIG. 1. A practical operation embodiment would be more complex as the result of conventional transistor circuit design features for faster settling times, avoidance of ambiguity in logic states, and increased reliability (none of which are shown). These features are all well known by those of average skill in the art of transistor circuit design. Components which are exactly the same as those in the circuit apparatus of FIG. 1 are given the same numerical reference character. Components which are transistorized equivalents of those in FIG. 1 are given the same numerical reference character with the addition of the suffix *a.* The reset winding and set winding drivers 28*a,* and 32*a,* respectively, comprise saturable switch transistors. Their respective control terminals 30*a* and 34*a* are the base electrodes of the their respective transistors. Feedback paths 42*a* and 44*a* include Zener diodes 62 and 64, respectively, which are poled with their Zener breakdown voltage in opposition to the feedback potentials appearing at the driven ends of set and reset windings 24 and 26. These Zener diodes are chosen to have a Zener breakdown voltage which is somewhat in excess of the magnitude of B+ power supply. They serve as d.c. decoupling means to keep the B+ power supply from actuating to driver transistors. The inhibit gate is a shunting or by-pass transistor 38*a* which stunts feedback path 44*a* to ground when a positive voltage is applied to its base. Comparator 48*a* provides a zero or negative output signal as long as the potential across capacitor 46 is less than the reference voltage of the flux density command signal, and produces a positive output when the voltage across capacitor 46 reaches the reference voltage.

Figure 5:
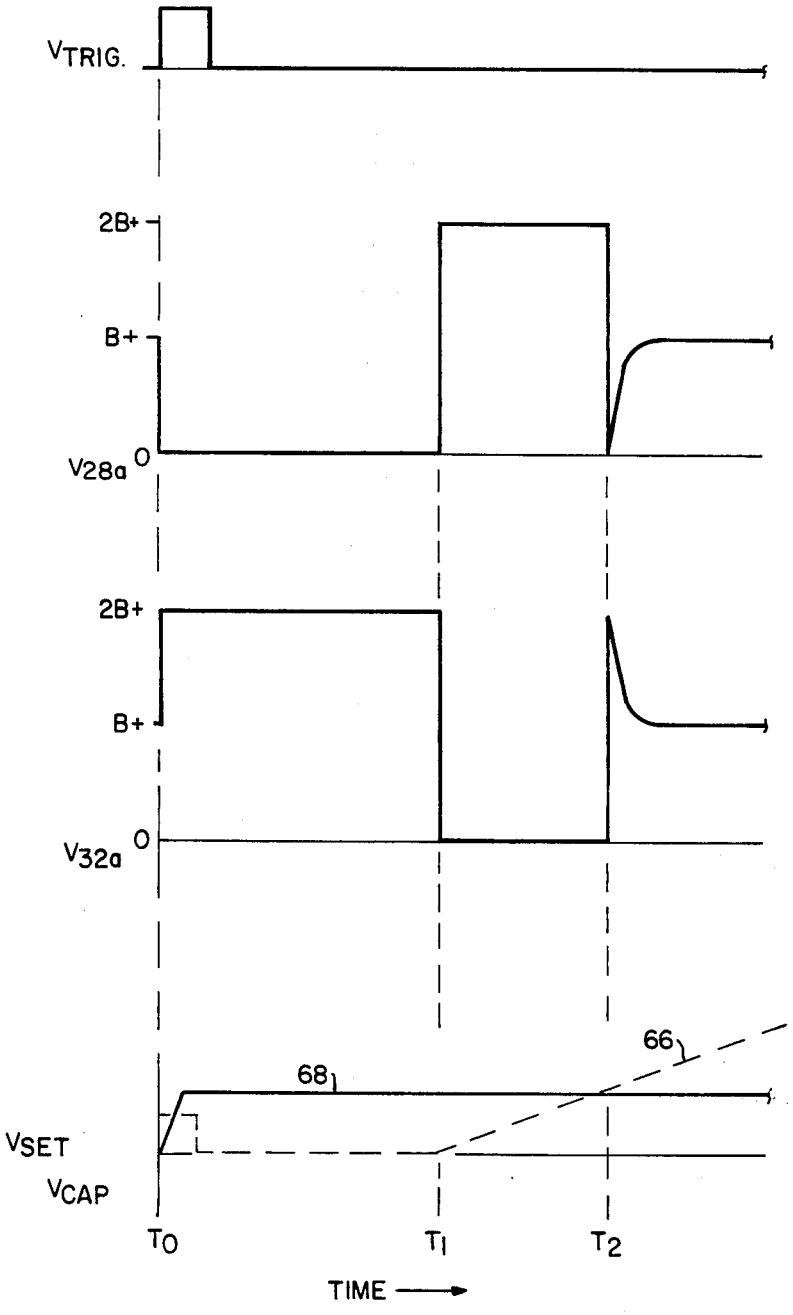
FIG. 5 is a family of waveforms which is referred to in describing the operation of the circuit of FIG. 4.

The operation of the transistorized embodiment of FIG. 4 will now be described with reference to the waveforms of FIG. 5, wherein: $V_{trig}$ is the starter trigger pulse waveform; $V_{28a}$ is the voltage waveform at the collector of transistor switch 28a; $V_{32a}$ is the voltage waveform at the collector of trigger switch 32a; and $V_{set}/V_{cap}$ represents the pair of voltage waveforms involving in the operation of comparator 48*a.* In the quiescence state the output of comparator 48*a* is a high signal applied to the base of bypass transistor 38*a.* At time $t_0$ a positive pulse, waveform $V_{trig}$ causes the reset transistor switch 28*a* to conduct. The inductive coupling through core 20 causes a positive potential at the driven end of set winding 26, resulting in positive step of waveform $V_{32a}$ of the collector voltage of transistor 32*a.* This potential exceeds the threshold of Zener diode 64 and therefore passes the Zener diode in feedback path 42a and is applied to the base 30*a* of reset drive transistor 28 to sustain same in its conduction condition. The conducting condition of reset transistor 28*a* results in zero voltage at its collector, waveform $V_{28a}$. This causes the previous charge on capacitor 46 to be dumped to ground via diode 52, which in turn causes comparator 48 to provide a LOW output. With its output LOW, inhibit gate transistor 38*a* no longer prevents application of feedback path 44*a* to the base 34*a* of set transistor 32*a.* At a time $t_1$ when core 20 reaches negative saturation, the collector of the reset driver transistor $V_{28}a$ swings positive with respect to the B+ power supply as the result of the voltage generated by the L(*di/dt*) of the collapsing field in the reset winding 24. This causes the set winding driver transistor 32a to turn on when Zener 62 conducts. Current now flows through the set winding 26 and a positive voltage apears at the driven end of winding 24, which appears as a positive step to 2B+ at the collector of transistor switch 28a. Feedback of the positive voltage via path 44a sustains saturation of transistor 32a. Capacitor 46 commences to take on a charge, dash curve 66 of waveforms $V_{set}/V_{cap}$. When at time $t_2$ the stored charge on capacitor 46 reaches the reference voltage of the flux density command signal, solid line 68 of waveforms $V_{set}/V_{cap}$, the comparator 48a produces a HIGH output, which is applied to the base of bypass inhibitor transistor 38*a.* The HIGH output from comparator 48*a* grounds the base electrode 34*a* of the set winding drive transistor 32*a.* The resulting cessation of current flow in the set winding causes the flux density of core 20 to move to a value which is the remanent flux density called for by the flux density command signal. The L(*di/dt*) in set winding 26 shown in waveform $V_{32a}$ is inhibited by the bypass transistor 38*a,* and therefore does not turn on the reset drive transistor 28*a.* The circuit returns to its quiescence state.

The circuit apparatuses thus far described have provided a setting sequence composed of two component elemental sequences, or cycles, consisting of a first cycle to reset the flux density to negative saturation and a second cycle to set it to the newly commanded set point. This two-cycle operation has the advantage of being the fastest possible mode of erasure of previous remanent flux density. However, it is limited in its accuracy tolerances. For example, in the case of a core 20 used in the programming of phase variations in conjunction with radiating elements of phased arrays, this two-cycle operation involves tolerances as large as 15-electrical degrees in controlling phase of radiating elements.

Figure 6:
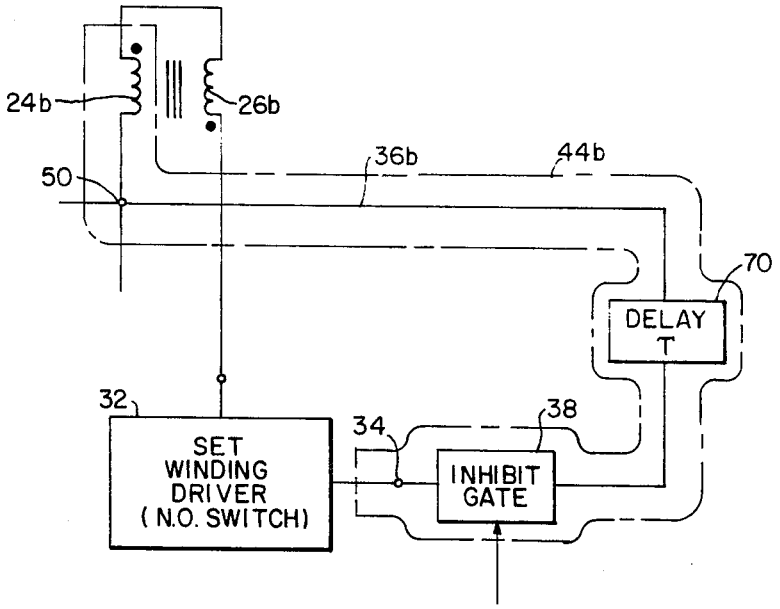
FIG. 6 is a fragment of a block diagram like the block diagram of FIG. 1, illustrating a modification of the circuit apparatus of FIG. 1.
Figure 7:
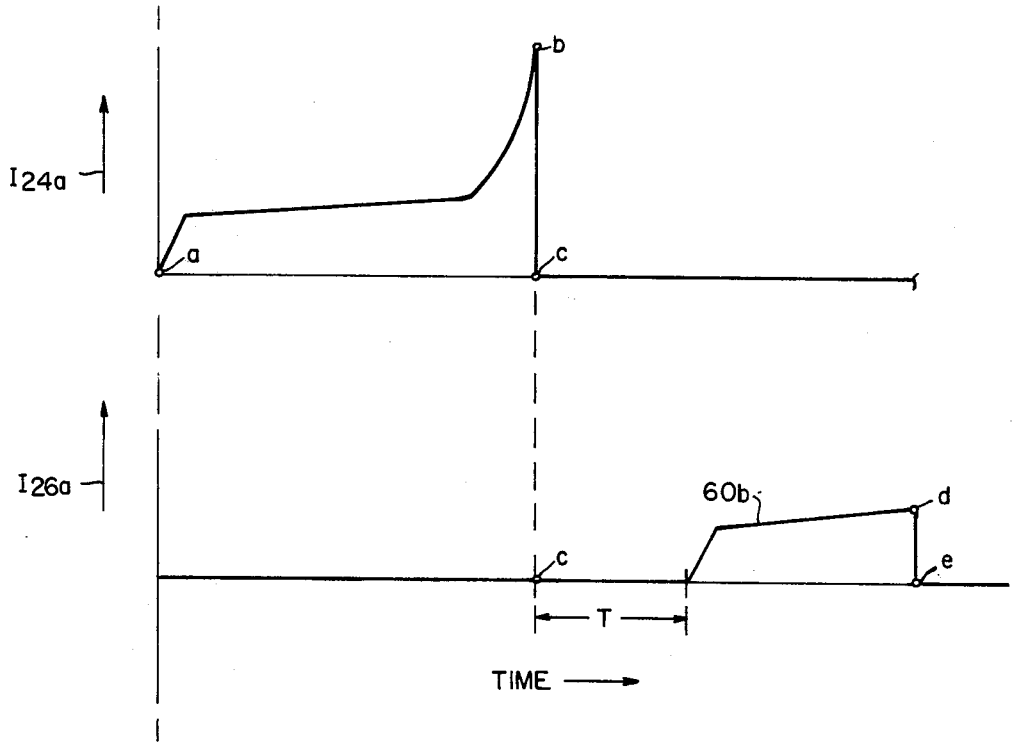
FIG. 7 is a pair of waveforms representing currents in the reset and the set windings of the modification of FIG. 6, during the operation thereof.

Reference is now made to FIGS. 6 and 7 which depict circuit apparatus like that of FIG. 1 in which the feedback path 44 is modified to provide greater accuracy. The suffix letter *b* is used with reference characters of items which correspond to those of FIGS. 1 and 3, but are modified. The modified feedback path 44*b* includes a delay circuit 70, which inserts a delay of time $\tau$. As can be seen from the set winding current wavefrom 60*b,* FIG. 7, the current flow through the set winding is delayed by this interval in the T. An improvement in accuracy results from the allowing of a settling time between the first and second cycle of the operating sequence.

Figure 8:
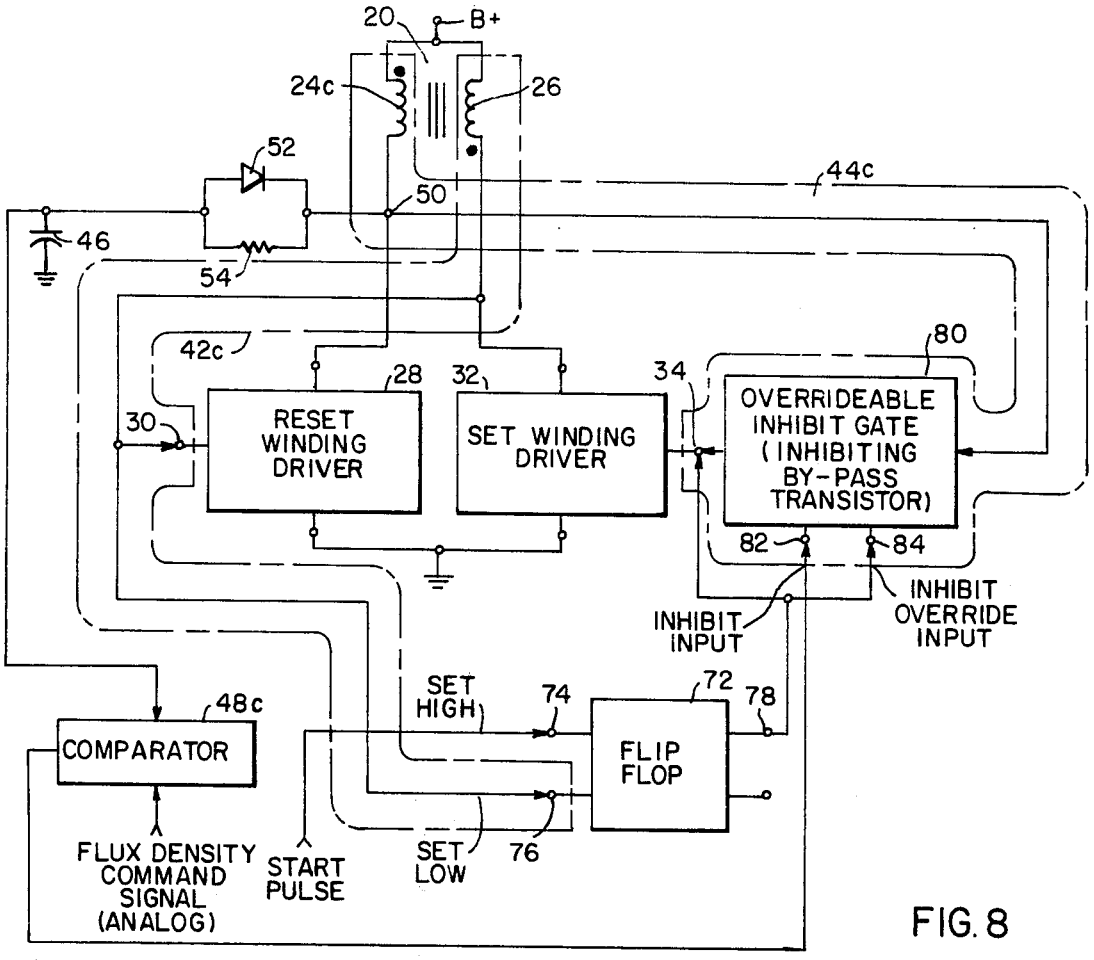
FIG. 8 is a block diagram of an alternate embodiment of invention.

FIG. 8 is an alternate embodiment of the invention which provides a three-cycle operating sequence. Except as will be described, all components are the same as in FIG. 1. The suffix letter *c* is used with reference characters of items which correspond to those of FIG. 1, but are modified.

A flip-flop 72 has a set high input 74 and a set low input 76. The application of a positive voltage to input 74 causes the flip-flop output terminal 78 to be in its high or positive voltage condition. A positive voltage applied to terminal 76 will set the flip-flop to provide a low output (zero or negative potential) at terminal 78. An overrideable inhibit gate 80 is series connected in feedback path 44*c.* It has a inhibit actuation terminal 82 and inhibit override terminal 84. The inhibit gate includes a bypass transistor of the same basic construction as inhibiting transistor 38*a*, FIG. 4. A positive voltage applied to terminal 82 drives the base of this transistor, subject to override action in connection with input 84. A high or positive signal applied to override terminal 84 actuates any suitable transistor logic or clamping circuit which clamps the base of the shunting transistor to ground irrespective of application of a positive voltage to terminal 82. Comparator 48*c* basically operates in the same way as comparator 48*a* of FIG. 4. That is, when the voltage charge on capacitor 46 equals the reference voltage of the flux density command signal, comparator 84*c* produces a positive voltage output for application to inhibit actuation terminal 82. The starter pulse is applied to the set high input terminal 74 of flip-flop 72. The output terminal 78 of flip-flop 72 is applied to both the control terminal of set winding driver 32 and to the inhibit override input 84 of overrideable inhibit gate 80.

The flux reset winding positive feedback path 42*c* applies the positive feedback to control terminal 30 of reset driver 28, just as was done in FIG. 1. However, here feedback path 42*c* also applies the positive feedback to the set low input terminal 76 of flip-flop 72.

Figure 9:
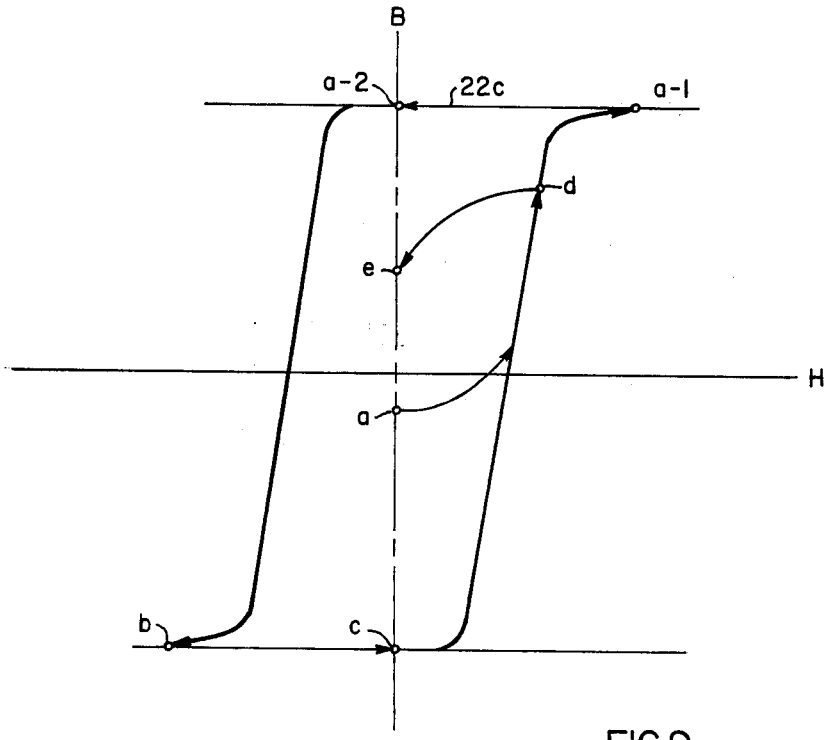
FIG. 9 is a curve representing the relationship of B versus H, like that of FIG. 2, but for the alternate embodiment of FIG. 8.
Figure 10:
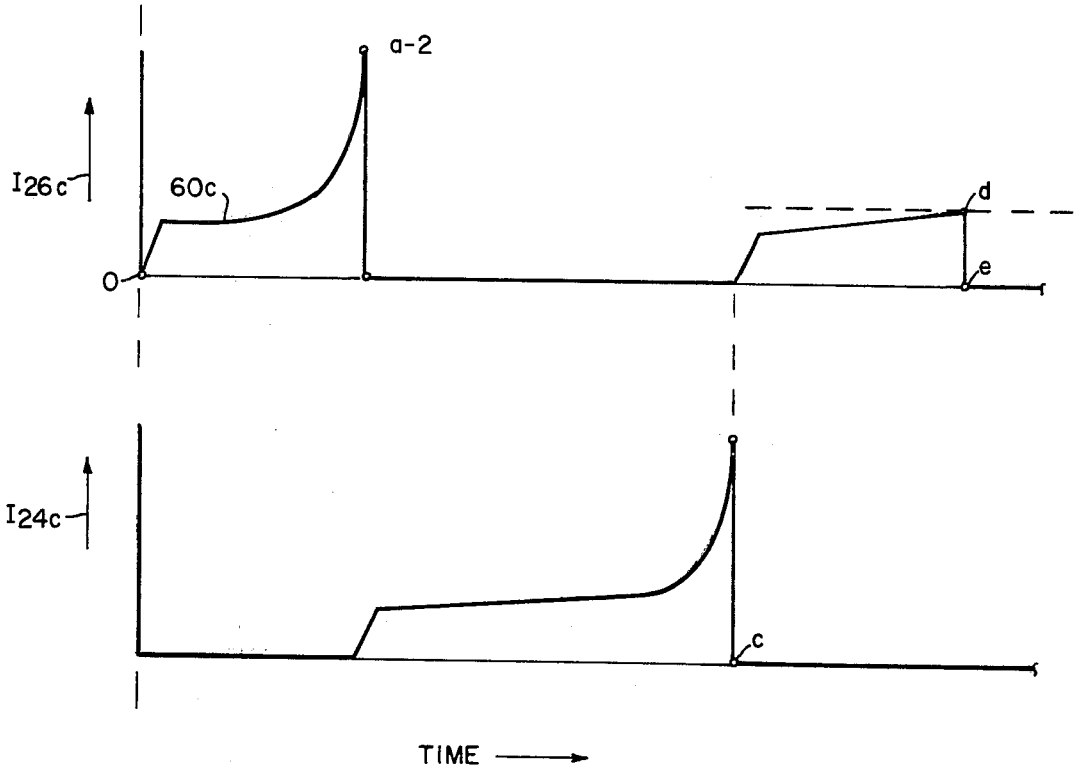
FIG. 10 is a pair of waveforms, representing currents in the set and reset windings during the operation of the circuit apparatus of FIG. 8.

The operation of the alternate embodiment of FIG. 8 will now be descussed with reference to B-H diagram of FIG. 9 and the set winding and reset winding current waveforms of FIG. 10. In the initial quiescence state core 20 is assumed to have a quiescence flux density represented by point *a* of curve 22*d* of FIG. 9. Comparator 48*c* is assumed to be in a state providing a positive output as the result of a previous charge on capacitor 46. A positive start trigger pulse applied to terminal 74 sets flip-flop terminal 78 to a HIGH state, which is coupled to a control terminal 34 and therefore turns on the set winding driver 33. The high state at terminal 78 as also coupled the inhibit override terminal 84, which allows the positive feedback path 44c to be established despite the presence of a positive signal at inhibit actuation terminal 82. Therefore, the conduction of driver 32 caused by the positive signal applied to its control terminal 34 is sustained by positive feedback. Current flows through the set winding as shown by the set winding current waveform curve 60*c,* FIG. 10. Flow of current through set winding 26 drives the flux density in core 20 in the direction of positive flux saturation along curve 22*c,* FIG. 9. The set winding current continues to flow until positive core saturation, point *a*-1 on curve 22*d,* FIG. 9 occurs. At that point the collapse of the field in set winding 26 generates a positive pulse which turns on reset winding driver 28 and resets flip-flop 72 to its low output state. With the cessation of set current, the flux density moves to the remanent position point *a*-2 of curve 22C, FIG. 9. From this point on the operating sequence is identical to that of the two-cycle operation previously described with reference to FIG. 1.

It will be appreciated that the three-cycle operation just described always up-dates the previous remanent flux state to full-set before reset is applied. The complete hysteresis loop, curve 22C, FIG. 9, is traversed in each sequence of setting a new flux density state. This results in the memory of the previous set point being more nearly completely erased than is done by a two-cycle sequence. This yields higher accuracies. For example, in the application of providing flux settings to program phase of antenna radiating elements, tolerances of 1–2 electrical degrees may be achieved with this three-cycle operation.

Among the other notable features of the type of circuitry which have been described herein are the following:

1. The set and reset drive cycles are generated independent of other timing and/or drive means.

2. Because the sensing of flux density for purposes of the comparator operation is via inductive coupling through the core, it compensates for changes in voltage, and to some degree for changes in temperatures.

3. The use of inherent electromagnetic feedback minimizes circuit complexity to the point where the entire circuit apparatus for setting magnetic remanence for a core can be constructed as a single monolithic integrated circuit chip.

We claim:

1. In circuit apparatus for selectively variably setting the magnetic remanence in a magnetizable core in accordance with a set control signal, the combination:

a. a core made of a magnetizable material having an approximately rectangular hysteresis characteristic, b. a voltage source providing a potential between a pair of output terminals, c. a pair of windings wound about and inductively coupled to said core, said pair of windings comprising a reset winding and a set winding, each of said pair of windings having an operating potential end and an induced regenerative signal end, the operating potential ends of both the reset and set windings being commonly connected to one of the output terminals of the voltage supply, the construction and arrangement being such that a current through the reset winding will induce into the set winding a voltage signal which at the feedback end of the set winding bears a regenerative feedback relationship to said current through the reset winding, and such that a current through the set winding will induce into the reset winding a voltage signal which at the feedback end of the reset winding bears a regenerative feedback relationship to said current through the set winding, d. a normally open reset winding switch device for operatively connecting the other terminal of the voltage source with the feedback end of the reset winding, said reset winding switch device having a control input connected to the feedback end of the set winding, said reset winding switch device being operative to change to its closed circuit condition in response to the application to its control input of a voltage of the polarity of a regenerative feedback signal which appears at the feedback end of the set winding.

e. a normally open set winding switch device for operatively connecting the other terminal of the voltage source with the feedback end of the set winding, said set winding switch having a control input and being operative to change to its closed circuit condition in response to the application to its control input of a voltage of the polarity of a regenerative feedback signal which appears at the feedback end of the set winding, said control input of the set winding switch device being connected to the regenerative feedback end of the reset winding whereby the collapsing flux associated with the reset winding following saturation of the core causes a voltage to be generated at the feedback end of the reset winding to actuate the set switch in its closed circuit condition, and f. signal inhibit means responsive to the set control signal and to the flow of current in set winding, said signal inhibit means being operative to terminate the application of the regenerative feedback signal from the feedback end of the reset winding to the control input of the set winding set device when the magnetization imparted to the core by flow of current through the set winding reaches a magnitude corresponding to the remanent magnetization called for by the set control signal.

2. Apparatus in accordance with claim 1, and;

a. trigger pulse means for initiating operation of the circuit apparatus, said trigger pulse means being operative to apply a pulse of the polarity of a regenerative feedback signal at the feedback end of the set winding to the control input of said reset winding switch device.

3. Apparatus in accordance with claim 1, and;

a. a flip-flop having its output connected to the control input of the set winding and which is operative to apply a voltage of the polarity of a regenerative signal which appears at the feedback end of the set winding to said control input when the flip-flop output is in a first predetermined state of its two bistable states;

b. means for initiating operation of the circuit apparatus, said means being operative to toggle the output state of the flip-flop to said first predetermined state, c. the feedback end of the set winding being operatively connected to the input of the flip-flop to toggle same to its second predetermined state of its two bistable states when the flux associated with the set winding collapses following saturation of the core.

4. Apparatus in accordance with claim 1, and;

a. delay circuit means, b. said feedback end of the reset winding being connected to the control input of the set winding switch through said delay circuit means.

5. Apparatus in accordance with claim 1, wherein;

a. said inhibit gate means includes an integrator circuit for integrating a voltage signal bearing a derivative relationship to flow of current through the set winding.

6. Apparatus in accordance with claim 5, wherein;

a. said integrator circuit comprises an integrator capacitor and an associated charge circuit for charging same in response to the voltage present at the feedback end of the reset winding.

7. Apparatus in accordance with claim 5, and;

a. means for resetting said integrator circuit to an initial condition prior to saturation of the core by current through the reset winding.

8. Apparatus in accordance with claim 6, wherein;

a. said integrator circuit includes an integrator capacitor, and b. said means for resetting the integrator circuit comprises a discharge diode which is connected between the integrator capacitor and the feedback end of the reset winding and which is poled to conduct when the reset winding is in the closed circuit condition.

9. Apparatus in accordance with claim 1, wherein;

a. said control input of the reset winding switch device being connected to the regenerative feedback end of the set winding through a first d.c. decoupling means, and b. said control input of the set winding switch device being connected to the regenerative feedback end of the reset winding through a second d.c. decoupling means.

10. Apparatus in accordance with claim 9, wherein;

a. said first and second d.c. decoupling means comprising first and second Zener diodes, which are respectively poled to prevent application of a signal to the connnected control input until the induced voltage at the connected regenerative feedback end of a winding exceeds the potential of said one output terminal of the voltage supply.

* * * * *